US006090537A

United States Patent [19]

Nakamura et al.

[11] Patent Number: 6,090,537

[45] Date of Patent: Jul. 18, 2000

[54] SILVER HALIDE PHOTOGRAPHIC MATERIAL

[75] Inventors: Tetsuo Nakamura; Ryuji Abe, both of Kanagawa, Japan

[73] Assignee: Fuji Photo Film Co., Ltd., Kanagawa, Japan

[21] Appl. No.: 09/146,530

[22] Filed: Sep. 3, 1998

[30] Foreign Application Priority Data

Sep. 4, 1997 [JP] Japan ..... 9-239895

[51] Int. Cl.[7] ..... G03C 1/18

[52] U.S. Cl. ..... 430/574; 430/585; 430/611

[58] Field of Search ..... 430/574, 585, 430/611

[56] References Cited

U.S. PATENT DOCUMENTS 4,362,813 12/1982 Mihara et al. .

5,368,999 11/1994 Makino ..... 430/569

*Primary Examiner*—Thorl Chea

*Attorney, Agent, or Firm*—Sughrue, Mion, Zinn, Macpeak & Seas, PLLC

[57] ABSTRACT

A silver halide photographic material is described which contains at least one compound represented by the following formula (I) and at least one compound represented by the following formula (II):

(I)

wherein $R^1$ and $R^2$ each represents an alkyl group; W represents a hydrogen atom, a methyl group or an ethyl group; $V^1$, $V^2$, $V^3$ and $V^4$ each represents a hydrogen atom, a fluorine atom, a chlorine atom, an alkoxyl group, a hydroxyl group or a carboxyl group; $X^1$ represents a counter ion; and m represents a number of 0 or more necessary for neutralizing a charge in the molecule;

(II)

wherein $R^3$ and $R^4$ each represents an alkyl group, and at least one of $R^3$ and $R^4$ represents a carboxyalkyl group or an alkanesulfonylcarbamoylalkyl group; Z represents a hydrogen atom, a methyl group or an ethyl group; Y represents an aryl group or a heterocyclic group; $V^5$ and $V^6$ each represents a hydrogen atom, a halogen atom, an alkoxyl group, a hydroxyl group or a carboxyl group; $X^2$ represents a counter ion; and n represents a number of 0 or more necessary for neutralizing a charge in the molecule.

6 Claims, No Drawings

SILVER HALIDE PHOTOGRAPHIC MATERIAL

FIELD OF THE INVENTION

The present invention relates to a silver halide photographic material and more particularly relates to a silver halide photographic material which has high sensitivity, generates less fog, exhibits excellent storage stability and generates less residual color after processing.

BACKGROUND OF THE INVENTION

Every endeavor has been made for enhancing sensitivity and for reduction of residual colors after processing of a silver halide photographic material. It is known that a sensitizing dye which is used for spectral sensitization largely affects capacities of a silver halide photographic material. A trace of structural difference of a sensitizing dye largely affects photographic capacities such as sensitivity, fog, storage stability and residual color after processing, and the combined use of two or more sensitizing dyes also greatly influences photographic capacities, but it is difficult to foresee its effect. Many engineers have hitherto synthesized various kinds of sensitizing dyes or have examined combinations of a variety of sensitizing dyes and endeavored to investigate photographic capacities thereby but it is not possible to know photographic capacities in advance yet.

Further, a trial of reduction sensitization for enhancing sensitivity of a silver halide photographic material has been studied heretofore. Various compounds are disclosed in many patents as useful reduction sensitizers, for example, tin compounds are disclosed in U.S. Pat. No. 2,487,850, polyamine compounds in U.S. Pat. No. 2,521,925, and thiourea dioxide compounds in British Patent 789,823. Further, in *Photographic Science and Engineering,* Vol. 23, p. 113 (1979), comparisons of natures of silver nuclei formed according to various reduction sensitizing methods are described and dimethylamineborane, stannous chloride, hydrazine, and methods of high pH ripening and low pAg ripening have been employed. Reduction sensitizing methods are also disclosed in U.S. Pat. Nos. 2,518,698, 3,201,254, 3,411,917, 3,779,777 and 3,930,867. Not only the selection of reduction sensitizers but contrivances of reduction sensitizing methods are disclosed in JP-B-57-33572 and JP-B-58-1410 (the term "JP-B" as used herein means an "examined Japanese patent publication").

From the above-described reasons, techniques of spectrally sensitizing silver halide grains (in particular, reduction sensitized silver halide grains) in a highly sensitive state and without causing malefic effects such as fog and residuals color have been demanded.

SUMMARY OF THE INVENTION

An object of the present invention is to provide a silver halide photographic material which has high sensitivity, generates less fog, is excellent in storage stability and generates less residual color after processing.

As a result of eager investigations, the above object of the present invention has been attained by the following means.

(1) A silver halide photographic material which contains at least one compound represented by the following formula (I) and at least one compound represented by the following formula (II):

(I)

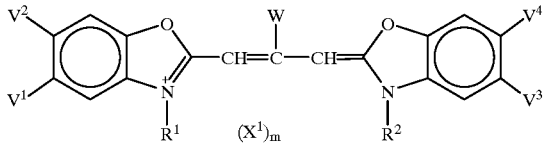

wherein $R^1$ and $R^2$ each represents an alkyl group; W represents a hydrogen atom, a methyl group or an ethyl group; $V^1$, $V^2$, $V^3$ and $V^4$ each represents a hydrogen atom, a fluorine atom, a chlorine atom, an alkoxyl group, a hydroxyl group or a carboxyl group; $X^1$ represents a counter ion; and m represents a number of 0 or more necessary for neutralizing a charge in the molecule;

(II)

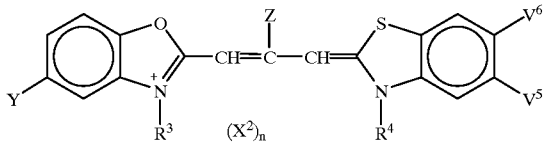

wherein $R^3$ and $R^4$ each represents an alkyl group, and at least one of $R^3$ and $R^4$ represents a carboxyalkyl group or an alkanesulfonylcarbamoylalkyl group; Z represents a hydrogen atom, a methyl group or an ethyl group; Y represents an aryl group or a heterocyclic group; $V^5$ and $V^6$ each represents a hydrogen atom, a halogen atom, an alkoxyl group, a hydroxyl group or a carboxyl group; $X^2$ represents a counter ion; and n represents a number of 0 or more necessary for neutralizing a charge in the molecule.

(2) The silver halide photographic material as described in (1), wherein said silver halide photographic material contains at least one compound represented by the following formula (III) and at least one compound represented by the following formula (IV):

(III)

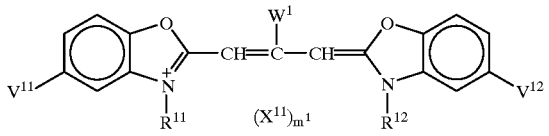

wherein $R^{11}$ and $R^{12}$ each represents a sulfoalkyl group; $W^1$ represents a methyl group or an ethyl group; $V^{11}$ and $V^{12}$ each represents a fluorine atom, a chlorine atom, an alkoxyl group or a hydroxyl group; $X^{11}$ represents a counter ion; and $m^1$ represents a number of 0 or more necessary for neutralizing a charge in the molecule;

(IV)

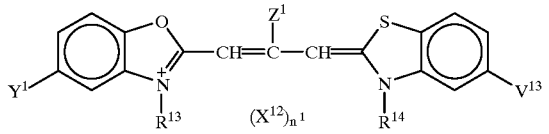

wherein $R^{13}$ represents a sulfoalkyl group; $R^{14}$ represents a carboxyalkyl group or an alkanesulfonylcarbamoylalkyl group; $Z^1$ represents a methyl group or an ethyl group; $Y^1$ represents an aryl group; $V^{13}$ represents a hydrogen atom, a fluorine atom, a chlorine atom, an alkoxyl group or a hydroxyl group; $X^{12}$ represents a counter ion; and $n^1$ represents a number of 0 or more necessary for neutralizing a charge in the molecule.

(3) A silver halide photographic material comprising a support having provided thereon at least one silver halide emulsion layer, wherein silver halide grains of said emulsion layer are reduction sensitized and said silver halide photographic material contains at least one compound represented by formula (I) and at least one compound represented by formula (II).

(4) The silver halide photographic material as described in (3) which comprises a support having provided thereon at least one silver halide emulsion layer, wherein silver halide grains of said emulsion layer are reduction sensitized and said silver halide photographic material contains at least one compound represented by formula (III) and at least one compound represented by formula (IV).

(5) The silver halide photographic material as described in (3) or (4), wherein said silver halide grains are reduction sensitized with at least one compound represented by the following formula (V), (VI) or (VII):

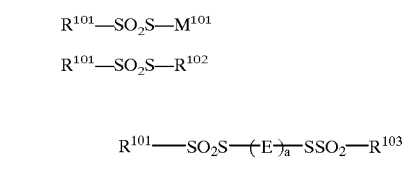

$$R^{101}—SO_2S—M^{101} \quad (V)$$

$$R^{101}—SO_2S—R^{102} \quad (VI)$$

$$R^{101}—SO_2S—(E)_a—SSO_2—R^{103} \quad (VII)$$

wherein $R^{101}$, $R^{102}$ and $R^{103}$ each represents an aliphatic group, an aromatic group or a heterocyclic group; $M^{101}$ represents a cation; E represents a divalent linking group, and a represents 0 or 1.

DETAILED DESCRIPTION OF THE INVENTION

Compounds for use in the present invention are described in detail below.

In formulae (I) and (II), examples of alkyl groups represented by $R^1$, $R^2$, $R^3$ and $R^4$ include an unsubstituted alkyl group having from 1 to 8, preferably from 1 to 4, carbon atoms (e.g., methyl, ethyl, propyl, isopropyl, butyl, isobutyl, hexyl), or a substituted alkyl group having from 1 to 8, preferably from 1 to 4, carbon atoms (substituents thereof include, e.g., a carboxyl group, a sulfo group, a cyano group, a halogen atom (e.g., fluorine, chlorine, bromine, iodine), a hydroxyl group, an alkoxycarbonyl group having from 1 to 7 carbon atoms (e.g., methoxycarbonyl, ethoxycarbonyl, benzyloxycarbonyl), an aryloxycarbonyl group having from 6 or 7 carbon atoms (e.g., phenoxycarbonyl), an alkoxyl group having from 1 to 7 carbon atoms (e.g., methoxy, ethoxy, benzyloxy), an aryloxy group having 6 or 7 carbon atoms (e.g., phenoxy, p-tolyloxy), an acyloxy group having from 1 to 7 carbon atoms (e.g., acetyloxy, propionyloxy), an acyl group having from 1 to 7 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), an aryl group having from 6 or 7 carbon atoms (e.g., phenyl, p-chlorophenyl, p-tolyl), a sulfonylcarbamoyl group, and an acylsulfamoyl group). More preferred examples include an alkyl group substituted with a dissociable group such as a carboxyalkyl group (e.g., carboxymethyl, 2-carboxyethyl), an alkanesulfonylcarbamoylalkyl group (e.g., methanesulfonylcarbamoylmethyl), and a sulfoalkyl group (e.g., 2-sulfoethyl, 3-sulfopropyl, 4-sulfobutyl, 3-sulfobutyl). In particular, it is essential that either $R^3$ or $R^4$ represents a carboxyalkyl group or an alkanesulfonylcarbamoylalkyl group, preferably $R^4$ represents a carboxyalkyl group or an alkanesulfonylcarbamoylalkyl group, more preferably $R^4$ represents a carboxymethyl group, a carboxyethyl group, or a methanesulfonylcarbamoylmethyl group, and particularly preferably a carboxymethyl group. $R^1$, $R^2$ and either of the remaining $R^3$ or $R^4$ preferably represent sulfoalkyl groups, particularly preferably 2-sulfoethyl, 3-sulfopropyl, 4-sulfobutyl, or 3-sulfobutyl.

In formulae (III) and (IV), $R^{11}$, $R^{12}$ and $R^{13}$ each represents a sulfoalkyl group, and particularly preferably 2-sulfoethyl, 3-sulfopropyl, 4-sulfobutyl, or 3-sulfobutyl.

In formula (IV), the carboxyalkyl group represented by $R^{14}$ is preferably carboxymethyl or carboxyethyl and the alkanesulfonylcarbamoylalkyl group represented by $R^{14}$ is preferably methanesulfonylcarbamoylmethyl. $R^{14}$ particularly preferably represents carboxymethyl.

W in formula (I) and Z in formula (II) each represents a hydrogen atom, a methyl group or an ethyl group, preferably a methyl group or an ethyl group.

In formula (II), the halogen atoms represented by $V^5$ and $V^6$ are preferably fluorine, chlorine, bromine and iodine, and more preferably fluorine and chlorine.

As the alkoxyl groups represented by $V^1$, $V^2$, $V^3$, $V^4$, $V^5$ and $V^6$ in formulae (I) and (II) and $V^{11}$, $V^{12}$ and $V^{13}$ in formulae (III) and (IV), methoxy and ethoxy are preferred and methoxy is more preferred.

$V^2$, $V^4$ and $V^6$ each more preferably represents a hydrogen atom and $V^1$, $V^3$, $V^{11}$ and $V^{12}$ each more preferably represents a fluorine atom or a chlorine atom. $V^5$ and $V^{13}$ each more preferably represents a hydrogen atom, a fluorine atom or a chlorine atom.

The aryl groups represented by Y in formula (II) and $Y^1$ in formula (IV) are substituted or unsubstituted aryl groups having from 6 to 15, preferably from 6 to 10, carbon atoms (e.g., phenyl, naphthyi, p-carboxyphenyl, p-nitrophenyl, p-chlorophenyl, 3,5-dichlorophenyl, p-bromophenyl, p-cyanophenyl, m-fluorophenyl, p-tolyl). The heterocyclic group represented Y in formula (II) is, e.g., a heterocyclic group having from 1 to 20, preferably from 2 to 10, and more preferably from 4 to 6, carbon atoms, which may be substituted (e.g., pyridyl, 5-methylpyridyl, thienyl, furyl, morpholino, tetrahydrofurfuryl). The heterocyclic group may have the structure of the condensation of a benzene ring, a naphthalene ring or an anthracene ring.

Y and $Y^1$ preferably represent aryl groups, in particular, phenyl groups.

$X^1$, $X^2$, $X^{11}$ and $X^{12}$ in formulae (I), (II), (III) and (IV) are included in the formulae to show the presence or absence of a cation or an anion when a counter ion is necessary for neutralizing an ionic charge in the molecule of the compound. Whether the dye is a compound having a cation, an anion or net ionic charge depends on the substituents. Examples of representative cations as a counter ion include an inorganic cation such as a hydrogen ion, an alkali metal ion (e.g., a sodium ion, a potassium ion, a lithium ion), and an alkaline earth metal ion (e.g., a calcium ion), and an organic cation such as an ammonium ion (e.g., an ammonium ion, a tetraalkylammonium ion, a pyridinium ion, an ethyl-pyridinium ion). Anions may be either inorganic or organic, and examples include a halide anion (e.g., a fluoride ion, a chloride ion, a bromide ion, an iodide ion), a substituted arylsulfonate ion (e.g., a p-toluenesulfonate ion, a p-chlorobenzenesulfonate ion), an aryldisulfonate ion (e.g., a 1,3-benzenedisulfonate ion, a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion, and a trifluoromethanesulfonate ion. In addition, ionic polymers or other dyes having a counter charge to the dye can also be used as a counter ion.

Preferred cations are a sodium ion, a potassium ion, a triethylammonium ion, a tetraethylammonium ion, a pyridinium ion, an ethylpyridinium ion, and a methylpyridinium ion. Preferred anions are a perchlorate ion, an iodide ion, a bromide ion, and a substituted arylsulfonate ion (e.g., a p-toluenesulfonate ion).

In the present invention, a sulfo group is described as $SO_3^-$, but it can be described as $SO_3H$ when the compound has a hydrogen ion as a counter ion.

m, n, $m^1$ and $n^1$ each represents a number of 0 or more necessary for balancing a charge in the molecule of the compound and when an inner salt is formed, the number is 0, preferably from 0 to 4.

Besides the sensitizing dyes represented by formulae (I), (II), (III) and (IV) according to the present invention, other sensitizing dyes may also be used. Sensitizing dyes are often used in combination, in particular, for the purpose of supersensitization. Representative examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, JP-B-43-4936, JP-B-53-12375, and JP-A-52-110618 and JP-A-52-109925 (the term "JP-A" as used herein means an "unexamined published Japanese patent application").

Specific examples of the compounds represented by formulae (I), (II), (III) and (IV) according to the present invention are shown below, but it should not be construed as the present invention is limited thereto.

I-1

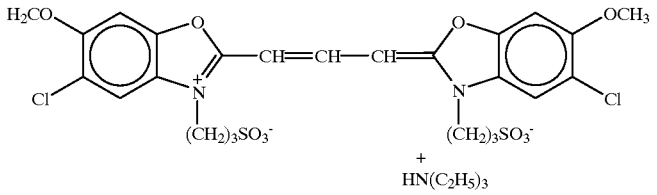

I-2

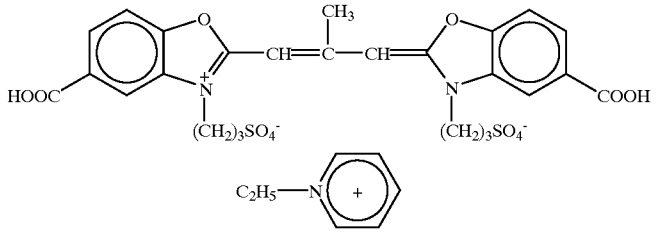

I-3

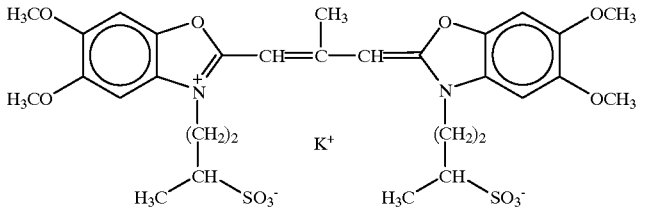

I-4

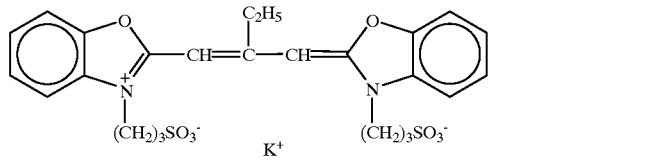

I-5

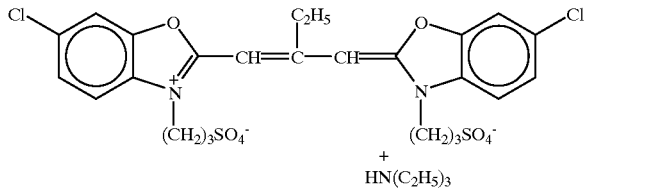

-continued
I-6
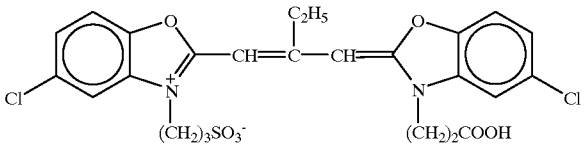
I-7
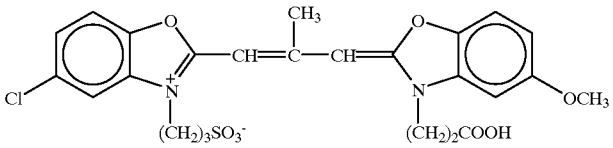
I-8
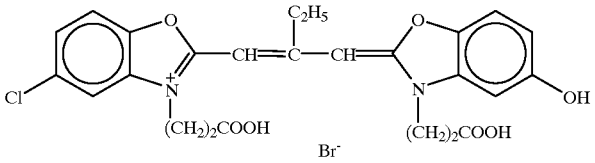
II-1
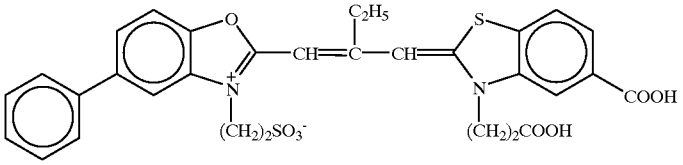
II-2
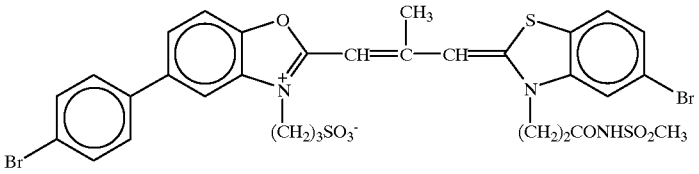
II-3
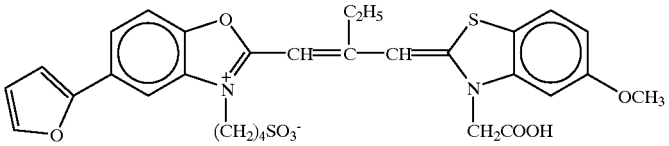
II-4
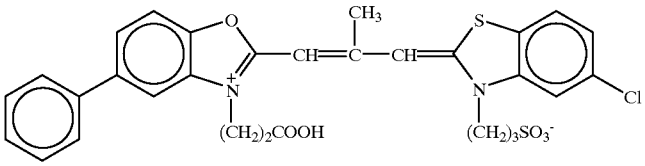
II-5
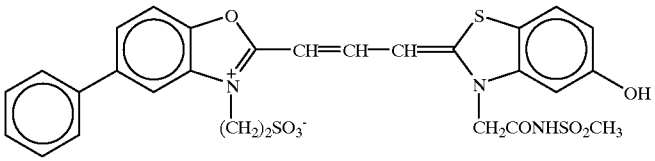
II-6
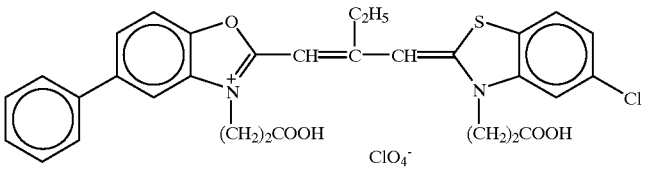

-continued
II-7
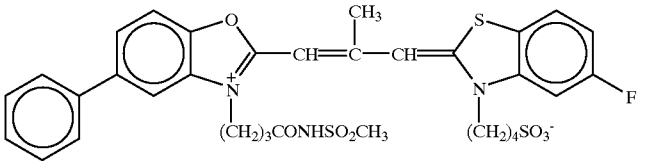
II-8
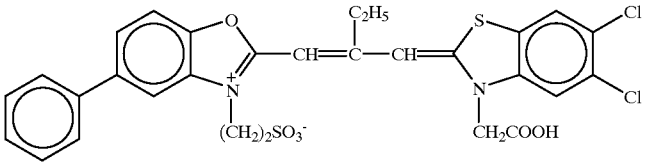
III-1
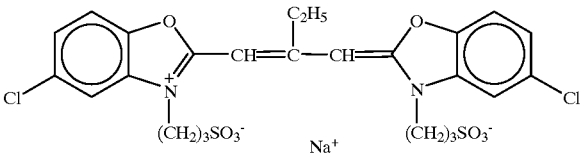
III-2
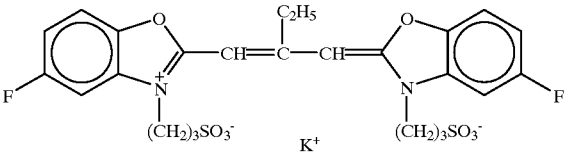
III-3
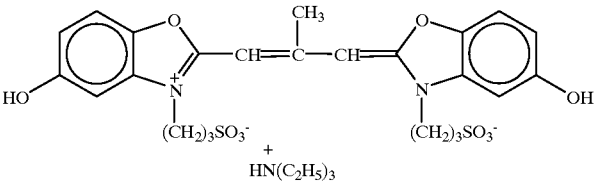
III-4
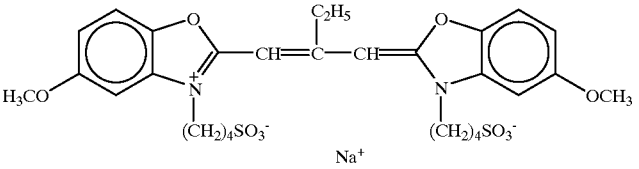
III-5
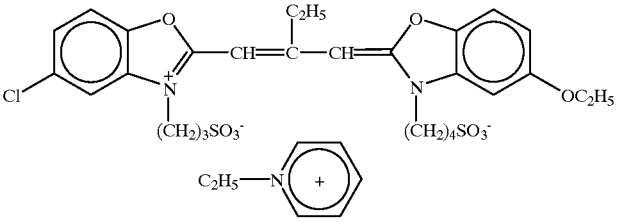
IV-1
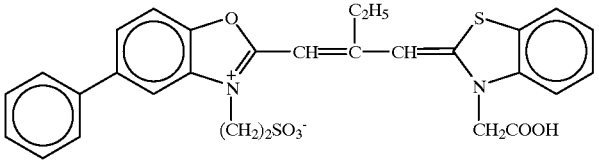

-continued

IV-2

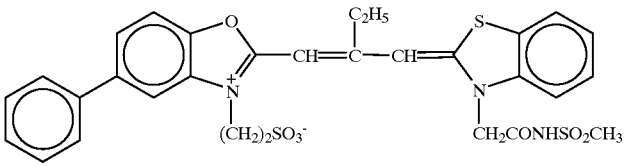

IV-3

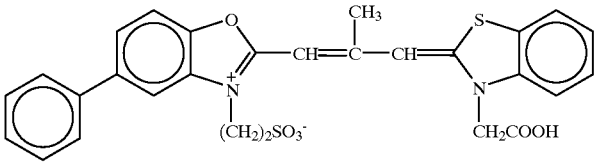

IV-4

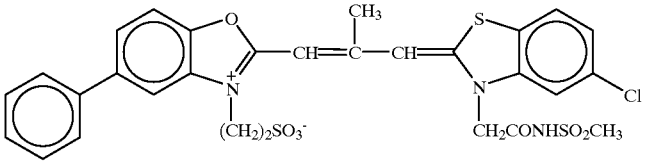

IV-5

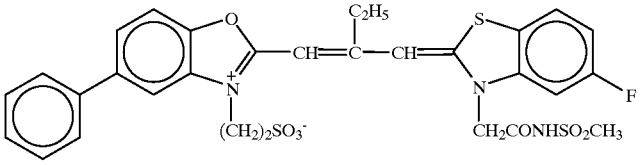

IV-6

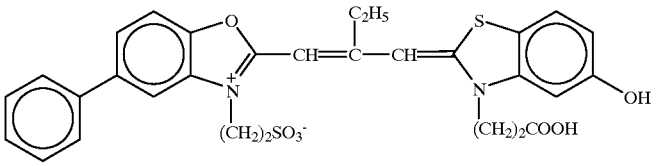

The compounds represented by formulae (I), (II), (III) and (IV) for use in the present invention can be synthesized according to the methods described in the following literature:

a) F. M. Harmer, *Heterocyclic Compounds—Cyanine Dyes and Related Compounds,* John Wiley & Sons, New York, London (1964)

b) D. M. Sturmer, *Heterocyclic Compounds—Special Topics in Heterocyclic Chemistry,* Chap. 18, Clause 14, pp. 482 to 515, John Wiley & Sons, New York, London (1977)

c) *Rodd's Chemistry of Carbon Compounds,* 2nd Ed., Vol. IV, Part B, Chap. 15, pp. 369 to 422, Elsevier Science Publishing Company Inc., New York (1977)

For the inclusion of the compounds represented by formulae (I), (II), (III) and (IV) according to the present invention in the silver halide emulsion for use in the present invention, they may be directly dispersed in the emulsion, or they may be dissolved in a single or mixed solvent of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., and then added to the emulsion.

In addition, various methods can be used for the inclusion of the dyes in the emulsion, for example, a method in which the dyes are dissolved in a volatile organic solvent, the solution is dispersed in water or hydrophilic colloid and this dispersion is added to the emulsion as disclosed in U.S. Pat. No. 3,469,987, a method comprising dispersing the water-insoluble dyes in a water-soluble solvent without dissolution and adding the dispersion to the emulsion as disclosed in JP-B-46-24185, a method in which the dyes are dissolved in acid and the solution is added to the emulsion, or the dyes are added to the emulsion as an aqueous solution coexisting with acid or base as disclosed in JP-B-44-23389, JP-B-44-27555 and JP-B-57-22091, a method in which the dyes are added to the emulsion as an aqueous solution or colloidal dispersion coexisting with a surfactant as disclosed in U.S. Pat. Nos. 3,822,135 and 4,006,026, a method in which the dyes are directly dispersed in a hydrophilic colloid and the dispersion is added to the emulsion as disclosed in JP-A-53-102733 and JP-A-58-105141, or a method comprising dissolving the dyes using a compound capable of red-shifting and adding the solution to the emulsion as disclosed in JP-A-51-74624 can be used. Further, ultrasonic waves can be used for dissolution.

The time of the addition of the compounds represented by formulae (I), (II), (III) and (IV) according to the present invention to the silver halide emulsion for use in the present invention may be at any stage of the preparation of the emulsion recognized as useful hitherto. For example, they may be added at any stage if it is before coating, i.e., before grain formation stage of silver halide grains and/or before desalting stage, during desalting stage and/or after desalting and before beginning of chemical sensitization, as disclosed in U.S. Pat. Nos. 2,735,766, 3,628,960, 4,183,756, 4,225, 666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical ripening. The kinds of compounds added separately and combinations of compounds may be varied.

Although the use amount of the compounds represented by formulae (I), (II), (III) and (IV) according to the present invention varies depending on the shapes and the sizes of silver halide grains to be used, but is generally from 0.1 to 4 mmol, preferably from 0.2 to 2.5 mmol, per mol of the silver halide. They may be used in combination with other sensitizing dyes.

It is preferred to use an oxidizing agent for silver during the production process of the emulsion for use in the present invention. An oxidizing agent for silver is a compound having a function of acting on metal silver and converting it to a silver ion. In particular, a compound which can convert superminute silver grains by-produced in the course of the formation of silver halide grains and chemical sensitization to a silver ion is effective. The silver ion formed may form hardly water-soluble silver salt such as silver halide, silver sulfide or silver selenide, or may form easily water-soluble silver salt such as silver nitrate. An oxidizing agent for silver may be inorganic or organic. Examples of inorganic oxidizing agents include ozone, oxyacid salt, such as hydrogen peroxide and addition products thereof (e.g., $NaBO_2.H_2O_2.3H_2O$, $2Na_2CO_3.3H_2O_2$, $Na_2P_2O_7.2H_2O_2$, $2Na_2SO_4.H_2O_2.2H_2O$), peroxyacid salt (e.g., $K_2S_2O_8$, $K_2C_2O_6$, $K_2P_2O_8$), a peroxy complex compound (e.g., $K_2[Ti(O_2)—C_2O_4].3H_2O$, $4K_2SO_4.Ti(O_2)OH.SO_4.2H_2O$, $Na_3[VO(O_2)(C_2H_4)_2].6H_2O$), permanganate (e.g., $KMnO_4$), and chromate (e.g., $K_2Cr_2O_7$), a halogen element such as iodine and bromine, perhalogen acid salt (e.g., potassium periodate), a metal salt of high valency (e.g., potassium hexacyanoferrate(III)), and thiosulfonate. Further, examples of organic oxidizing agents include quinones such as p-quinone, an organic peroxide such as peracetic acid and perbenzoic acid, a compound which releases active halogen (e.g., N-bromosuccinimide, chloramine T, chloramine B).

Disulfide compounds disclosed in EP-A-627657 are more preferred oxidizing agents.

The oxidizing agents which are preferably used in the present invention are inorganic oxidizing agents such as ozone, hydrogen peroxide and addition products thereof, a halogen element, and thiosulfonate, and organic oxidizing agents such as quinones. It is preferred to use the above-described reduction sensitization in combination with an oxidizing agent for silver. The method of usage can be selected from a method in which an oxidizing agent is used and then reduction sensitization is carried out, an inverse method thereof, or a method in which both are concurred with. These methods can be used selectively in a grain formation process or in a chemical sensitization process.

The silver halide photographic material of the present invention preferably contains at least one compound selected from the compounds represented by formula (V), (VI) or (VII).

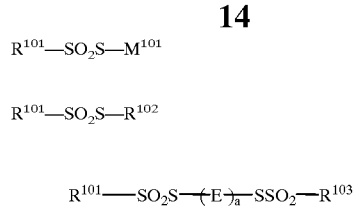

$$R^{101}—SO_2S—M^{101} \quad (V)$$

$$R^{101}—SO_2S—R^{102} \quad (VI)$$

$$R^{101}—SO_2S—(E)_a—SSO_2—R^{103} \quad (VII)$$

wherein $R^{10}$, $R^{102}$ and $R^{103}$ each represents an aliphatic group, an aromatic group or a heterocyclic group; $M^{101}$ represents a cation; E represents a divalent linking group, and a represents 0 or 1.

The compounds represented by formula (V), (VI) and (VII) are described in detail below.

When $R^{101}$, $R^{102}$ and $R^{103}$ each represents an aliphatic group, the aliphatic group is preferably an alkyl group having from 1 to 22 carbon atoms, an alkenyl group having from 2 to 22 carbon atoms, or an alkynyl group having from 2 to 22 carbon atoms, and these groups may be substituted. Examples of alkyl groups include, e.g., methyl, ethyl, propyl, butyl, pentyl, hexyl, octyl, 2-ethylhexyl, decyl, dodecyl, hexadecyl, octadecyl, cyclohexyl, isopropyl and t-butyl.

Examples of alkenyl groups include, e.g., allyl and butenyl.

Examples of alkynyl groups include, e.g., propargyl and butynyl.

When $R^{101}$, $R^{102}$ and $R^{103}$ each represents an aromatic group, the aromatic group is preferably an aromatic group having from 6 to 20 carbon atoms, e.g., phenyl and naphthyl. These groups may be substituted.

When $R^{101}$, $R^{102}$ and $R^{103}$ each represents a heterocyclic group, the heterocyclic group is a 3 to 15-membered ring having at least one element selected from nitrogen, oxygen, sulfur, selenium or tellurium. Examples of heterocyclic rings include, e.g., a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tetrazole ring, a triazole ring, a benzotriazole ring, a tetrazole ring, an oxadiazole ring, and a thiadiazole ring.

Examples of substituents for $R^{101}$, $R^{102}$ and $R^{103}$ include, e.g., an alkyl group (e.g., methyl, ethyl, hexyl), an alkoxyl group (e.g., methoxy, ethoxy, octyloxy), an aryl group (e.g., phenyl, naphthyl, tolyl), a hydroxyl group, a halogen atom (e.g., fluorine, chlorine, bromine, iodine), an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methanesulfonyl, benzenesulfonyl), an acylamino group (e.g., acetylamino, benzoylamino), a sulfonylamino group (e.g., methanesulfonylamino, benzenesulfonylamino), an acyloxy group (e.g., acetoxy, benzoxy), a carboxyl group, a cyano group, a sulfo group, and an amino group.

E preferably represents a divalent aliphatic group or a divalent aromatic group. Examples of divalent aliphatic groups represented by E include, e.g., $—(CH_2)_n—$ (n is from 1 to 12), $—CH_2—CH=CH—CH_2—$,

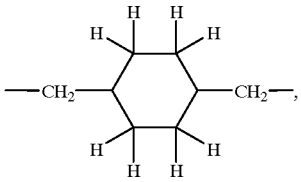

$—CH_2—C≡C—CH_2—$, a xylylene group, etc.

Examples of divalent aromatic groups represented by E include, e.g., phenylene and naphthylene.

$M^{101}$ preferably represents a metal ion or an organic cation. Examples of metal ions include a lithium ion, a sodium ion, and a potassium ion. Examples of organic cations include an ammonium ion (e.g., ammonium, tetramethylammonium, tetrabutylammonium), a phosphonium ion (e.g., tetraphenylphosphonium), a guanidinium ion, etc.

Specific examples of the compounds represented by formula (V), (VI) or (VII) are shown below, but the present invention is not limited to these compounds.

(V-1)

$CH_3SO_2SNa$ (V-2)

$C_2H_5SO_2SNa$ (V-3)

$C_3H_7SO_2SK$ (V-4)

$C_4H_9SO_2SLi$ (V-5)

$C_6H_{13}SO_2SNa$ (V-6)

$C_8H_{17}SO_2SNa$ (V-7)

$CH_3(CH_2)_3CH(C_2H_5)CH_2SO_2S{\bullet}NH_4$ (V-8)

$C_{10}H_{21}SO_2SNa$ (V-9)

$C_{12}H_{25}SO_2SNa$ (V-10)

$C_{16}H_{33}SO_2SNa$ (V-11)

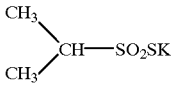

(V-12)

t-$C_4H_9SO_2SNa$ (V-13)

$CH_3OCH_2CH_2SO_2S{\bullet}Na$ (V-14)

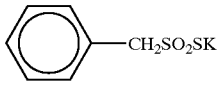

(V-15)

$CH_2{=}CHCH_2SO_2SNa$

-continued (V-16)

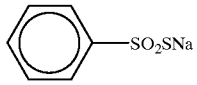

(V-17)

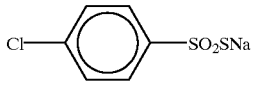

(V-18)

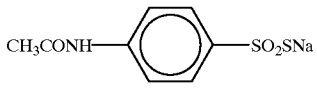

(V-19)

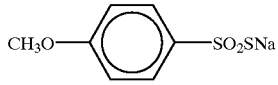

(V-20)

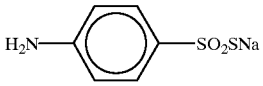

(V-21)

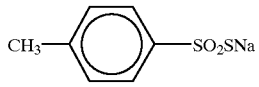

(V-22)

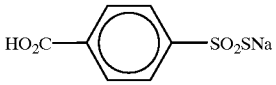

(V-23)

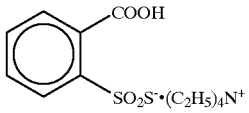

(V-24)

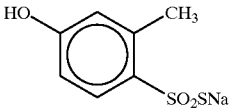

(V-25)

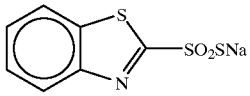

(V-26)

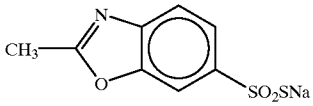

(V-27)

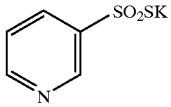

(V-28)

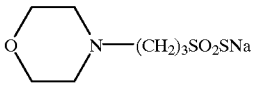

(V-29)

$KSSO_2(CH_2)_2SO_2SK$

-continued
(V-30)
$NaSSO_2(CH_2)_4SO_2SNa$
(V-31)
$NaSSO_2(CH_2)_4S(CH_2)_4SO_2SNa$
(V-32)
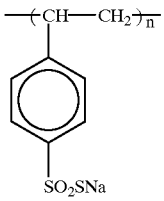
average molecular weight: about 6,000–60,000
(V-33)
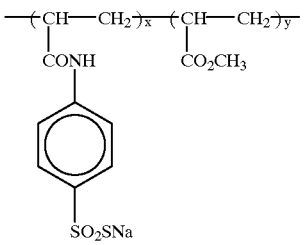
average molecular weight: about 8,000–80,000
x/y = 1/1 (mol ratio)
(VI-1)
$C_2H_5SO_2S—CH_3$
(VI-2)
$C_8H_17SO_2SCH_2CH_3$
(VI-3)
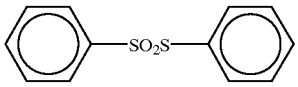
(VI-4)
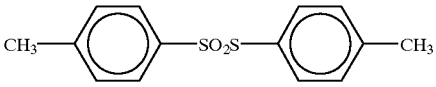
(VI-5)
$C_2H_5SO_2SCH_2CH_2CN$
(VI-6)
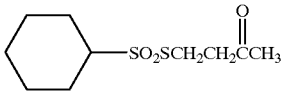
(VI-7)
$C_4H_9SO_2\overset{O}{\overset{\|}{S}}CHCH_2CN$
(VI-8)
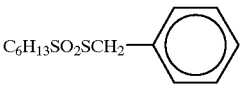
(VI-9)
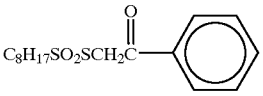
-continued
(VI-10)
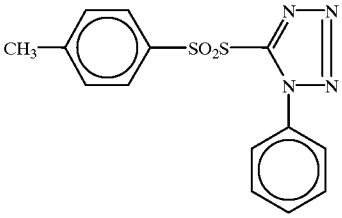
(VI-11)
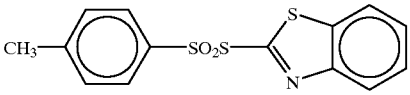
(VI-12)
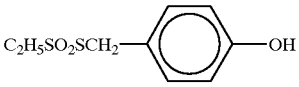
(VI-13)
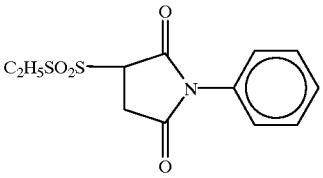
(VI-14)
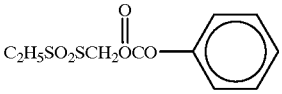
(VI-15)
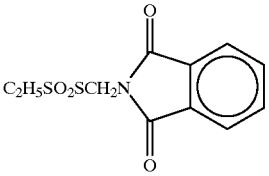
(VI-16)
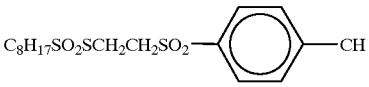
(VI-17)
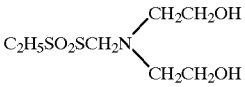
(VI-18)
$C_2H_5SO_2SCH_2CH_2CH_2CH_2OH$
(VI-19)
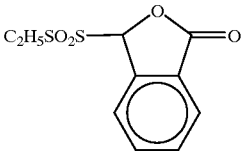
(VI-20)
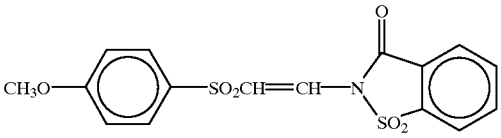

-continued (VI-21)

$CH_3SSO_2(CH_2)_4SO_2SCH_3$ (VI-22)

$CH_3SSO_2(CH_2)_2SO_2SCH_3$ (VI-23)

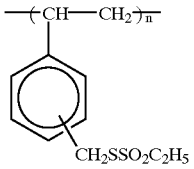

average molecular weight: about 3,000–30,000

(VI-24)

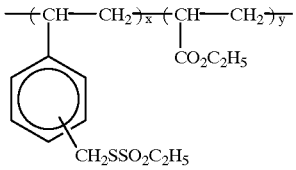

average molecular weight: about 5,000–50,000
x/y = 2/1 (mol ratio)

(VI-25)

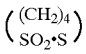

(VII-1)

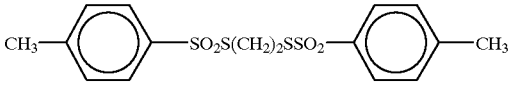

(VII-2)

$C_2H_5SO_2SCH_2CH_2SO_2CH_2CH_2SSO_2C_2H_5$ (VII-3)

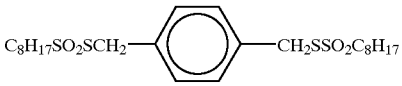

(VII-4)

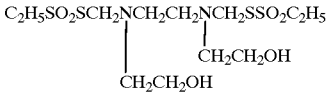

(VII-5)

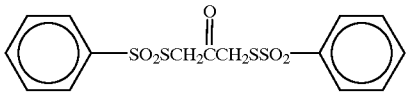

(VII-6)

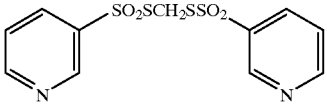

(VII-7)

$C_2H_5SO_2SSSO_2C_2H_5$ (VII-8)

$(n)C_3H_7SO_2SSSO_2C_3H_7(n)$ (VII-9)

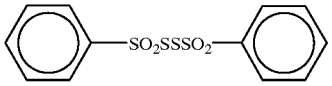

The compound represented by formula (V) can be easily synthesized according to the methods disclosed in JP-A-54-1019 and British Patent 972,211.

The compound represented by formula (V), (VI) or (VII) is preferably added in an amount of from $10^{-7}$ to $10^{-1}$ mol, more preferably from $10^{-6}$ to $10^{-2}$ mol, and particularly preferably from $10^{-5}$ to $10^{-3}$ mol, per mol of the silver halide.

For adding the compound represented by formula (V), (VI) or (VII) to an emulsion during the production process thereof, methods usually used for adding additives to a photographic emulsion can be used. For example, a compound which is soluble in water is added as an aqueous solution having proper concentration, and a compound which is insoluble or hardly soluble in water is dissolved in an appropriate organic solvent which is miscible with water and does not adversely affect photographic properties and which is selected from alcohols, glycols, ketones, esters or amides, and added as a solution.

The compound represented by formula (V), (VI) or (VII) can be added to an emulsion at any stage such as during the grain formation of a silver halide emulsion, before or after chemical sensitization. The compound is preferably added before reduction sensitization is conducted or during reduction sensitization is being conducted. The compound is particularly preferably added during grain growing.

The compound may be previously added to a reaction vessel but it is more preferred to be added at an appropriate stage during grain formation. Further, the method comprising previously adding the compound represented by formula (V), (VI) or (VII) to an aqueous solution of water-soluble silver salt or an aqueous solution of water-soluble alkali halide and forming grains using these aqueous solutions can be employed. In addition, the solution of the compound represented by formula (V), (VI) or (VII) may be divided to several parts and added in several times or may be added continuously over a long period of time with the degree of the grain formation.

Of the compounds represented by formula (V), (VI) or (VII), the compound represented by formula (V) is most preferably used in the present invention.

With respect to various techniques and inorganic and organic materials which can be used in the silver halide photographic material according to the present invention, in general, those disclosed in *Research Disclosure,* Nos. 308119 (1989) and 37038 (1995) can be used.

In addition to these, more specifically, for example, techniques and inorganic and organic materials which can be used in the color photographic material to which the silver halide photographic emulsion of the present invention is applicable are disclosed in the following places of EP-A-436938 and the patents cited in the following places.

| Item | Place |
|---|---|
| 1) Layer Structure | line 34, page 146 to line 25, page 147 |
| 2) Silver Halide Emulsion | line 26, page 147 to line 12, page 148 |
| 3) Yellow Coupler | line 35, page 137 to line 33, page 146, lines 21 to 23, page 149 |
| 4) Magenta Coupler | lines 24 to 28, page 149; line 5, page 3 to line 55, page 25 of EP-A-421453 |
| 5) Cyan Coupler | lines 29 to 33, page 149; line 28, page 3 to line 2, page 40 of EP-A-432804 |
| 6) Polymer Coupler | lines 34 to 38, page 149; line 39, page 113 to line 37, page 123 of EP-A-435334 |

-continued

| Item | Place |
|---|---|
| 7) Colored Coupler | line 42, page 53 to line 34, page 137, lines 39 to 45, page 149 |
| 8) Other Functional Coupler | line 1, page 7 to line 41, page 53, line 46, page 149 to line 3 page 150; line 1, page 3 to line 50, page 29 of EP-A-435334 |
| 9) Preservative | lines 25 to 28, page 150 |
| 10) Formalin Scavenger | lines 15 to 17, page 149 |
| 11) Other Additives | lines 38 to 47, page 153; line 21, page 75 to line 56, page 84 of EP-A-421453 |
| 12) Dispersion Method | lines 4 to 24, page 150 |
| 13) Support | line 32 to 34, page 150 |
| 14) Film Thickness, Physical Properties of Film | lines 35 to 49, page 150 |
| 15) Color Development Process | line 50, page 150 to line 47, page 151 |
| 16) Desilvering Process | line 48, page 151 to line 53, page 152 |
| 17) Automatic Processor | line 54, page 152 to line 2, page 153 |
| 18) Washing and Stabilizing Processes | lines 3 to 37, page 153 |

The silver halide emulsion prepared according to the present invention can be used in color photographic materials, e.g., a color paper, a color film for photographing, and a color reversal film, and black-and-white photographic materials, e.g., an X-ray film, a general film for photographing, and a photographic film for photomechanical process. The silver halide emulsion prepared according to the present invention is preferably used in a color reversal film.

Exposure methods of silver halide photographic materials according to the present invention are described. Exposure for obtaining photographic images may be performed in usual methods. That is, any of well-known various light sources can be used as exposure light sources, e.g., natural light (sunlight), a tungsten lamp, a fluorescent lamp, a mercury lamp, a xenon arc lamp, a carbon arc lamp, a xenon flash lamp, a laser light, an emission diode, and CRT. Exposure time of shorter than 1/1,000 sec., e.g., from $1/10^4$ to $1/10^6$ sec. using a xenon flash lamp, and longer than 1 sec. can be used, as well as exposure of from 1/1,000 to 1 sec. used in usual cameras. If necessary, spectral composition of the light for use in exposure can be adjusted using a color filter. Exposure can be effected using light emitted from fluorescent materials excited by an electron beam, an X-ray, a γ-ray or an α-ray.

The present invention will be illustrated in more detail with reference to examples below, but these are not to be construed as limiting the invention.

EXAMPLE 1

Preparation of Sample No. 101:

A multilayer color photographic material was prepared as Sample No. 101 by coating each layer having the following composition on an undercoated cellulose triacetate film support having the thickness of 127 μm. The numeral corresponding to each component indicates the addition amount per $m^2$. The function of the compounds added is not limited to the use described.

| | | |
|---|---|---|
| **First Layer: Antihalation Layer** | | |
| Black Colloidal Silver | silver amount: | 0.28 g |
| Gelatin | | 2.20 g |
| Ultraviolet Absorber U-1 | | 0.27 g |
| Ultraviolet Absorber U-3 | | 0.08 g |
| Ultraviolet Absorber U-4 | | 0.08 g |
| High Boiling Point Organic Solvent Oil-1 | | 0.29 g |
| Coupler C-9 | | 0.12 mg |
| **Second Layer: Interlayer** | | |
| Gelatin | | 0.38 g |
| Compound Cpd-K | | 5.0 mg |
| Ultraviolet Absorber U-2 | | 3.0 mg |
| High Boiling Point Organic Solvent Oil-3 | | 0.06 g |
| Dye D-4 | | 10.0 mg |
| **Third Layer: Interlayer** | | |
| Yellow Colloidal Silver | silver amount: | 0.007 g |
| Gelatin | | 0.40 g |
| **Fourth Layer: First Red-Sensitive Emulsion Layer** | | |
| Emulsion A | silver amount: | 0.55 g |
| Emulsion B | silver amount: | 0.23 g |
| Surface Fogged Fine Grain Silver Iodobromide Emulsion (average grain diameter: 0.11 μm) | silver amount: | 0.07 g |
| Gelatin | | 1.11 g |
| Coupler C-1 | | 0.04 g |
| Coupler C-2 | | 0.09 g |
| Compound Cpd-A | | 1.0 mg |
| Compound Cpd-E | | 0.14 g |
| Compound Cpd-K | | 2.0 mg |
| Compound Cpd-H | | 4.4 mg |
| High Boiling Point Organic Solvent Oil-2 | | 0.09 g |
| **Fifth Layer: Second Red-Sensitive Emulsion Layer** | | |
| Emulsion C | silver amount: | 0.14 g |
| Emulsion D | silver amount: | 0.28 g |
| Gelatin | | 0.65 g |
| Coupler C-1 | | 0.05 g |
| Coupler C-2 | | 0.11 g |
| Compound Cpd-E | | 0.10 g |
| High Boiling Point Organic Solvent Oil-2 | | 0.09 g |
| **Sixth Layer: Third Red-Sensitive Emulsion Layer** | | |
| Emulsion E | silver amount: | 0.50 g |
| Gelatin | | 1.56 g |
| Coupler C-3 | | 0.63 g |
| Compound Cpd-E | | 0.11 g |
| Additive P-1 | | 0.16 g |
| High Boiling Point Organic Solvent Oil-2 | | 0.04 g |
| **Seventh Layer: Interlayer** | | |
| Gelatin | | 0.50 g |
| Compound Cpd-D | | 0.04 g |
| High Boiling Point Organic Solvent Oil-3 | | 0.08 g |
| **Eighth Layer: Interlayer** | | |
| Yellow Colloidal Silver | silver amount: | 0.01 g |
| Gelatin | | 1.56 g |
| Compound Cpd-A | | 0.12 g |
| Compound Cpd-I | | 0.04 mg |
| Compound Cpd-J | | 0.07 g |
| High Boiling Point Organic Solvent Oil-3 | | 0.15 g |
| **Ninth Layer: First Green-Sensitive Emulsion Layer** | | |
| Emulsion F | silver amount: | 0.42 g |
| Emulsion G | silver amount: | 0.38 g |

-continued

| | | |
|---|---|---|
| Emulsion H | silver amount: | 0.32 g |
| Surface Fogged Core/Shell Type Fine Grain Silver Bromide Emulsion (average grain diameter: 0.11 μm) | silver amount: | 0.08 g |
| Gelatin | | 1.53 g |
| Coupler C-7 | | 0.07 g |
| Coupler C-8 | | 0.17 g |
| Compound Cpd-B | | 0.30 mg |
| Compound Cpd-C | | 2.00 mg |
| Compound Cpd-K | | 3.0 mg |
| Polymer Latex P-2 | | 0.02 g |
| High Boiling Point Organic Solvent Oil-2 | | 0.10 g |
| Tenth Layer: Second Green-Sensitive Emulsion Layer | | |
| Emulsion I | silver amount: | 0.16 g |
| Emulsion J | silver amount: | 0.34 g |
| Gelatin | | 0.75 g |
| Coupler C-4 | | 0.20 g |
| Compound Cpd-B | | 0.03 g |
| Polymer Latex P-2 | | 0.01 g |
| High Boiling Point Organic Solvent Oil-2 | | 0.01 g |
| Eleventh Layer: Third Green-Sensitive Emulsion Layer | | |
| Emulsion K | silver amount: | 0.44 g |
| Gelatin | | 0.91 g |
| Coupler C-4 | | 0.34 g |
| Compound Cpd-B | | 0.06 g |
| Polymer Latex P-2 | | 0.01 g |
| High Boiling Point Organic Solvent Oil-2 | | 0.02 g |
| Twelfth Layer: Yellow Filter Layer | | |
| Yellow Colloidal Silver | silver amount: | 0.02 g |
| Gelatin | | 0.73 g |
| Microcrystal Dispersion of Dye E-1 | | 0.24 g |
| Compound Cpd-G | | 0.02 g |
| Compound Cpd-J | | 0.04 g |
| High Boiling Point Organic Solvent Oil-3 | | 0.08 g |
| Polymer M-1 | | 0.23 g |
| Thirteenth Layer: First Blue-Sensitive Emulsion Layer | | |
| Emulsion L | silver amount: | 0.35 g |
| Gelatin | | 0.55 g |
| Coupler C-5 | | 0.20 g |
| Coupler C-6 | | 4.00 g |
| Coupler C-10 | | 0.02 g |
| Compound Cpd-E | | 0.07 g |
| Compound Cpd-K | | 0.03 mg |
| Fourteenth Layer: Second Blue-Sensitive Emulsion Layer | | |
| Emulsion M | silver amount: | 0.06 g |
| Emulsion N | silver amount: | 0.10 g |
| Gelatin | | 0.75 g |
| Coupler C-5 | | 0.35 g |
| Coupler C-6 | | 5.00 g |

-continued

| | | |
|---|---|---|
| Coupler C-10 | | 0.30 g |
| Compound Cpd-E | | 0.04 g |
| Fifteenth Layer: Third Blue-Sensitive Emulsion Layer | | |
| Emulsion O | silver amount: | 0.20 g |
| Emulsion P | silver amount: | 0.02 g |
| Gelatin | | 2.40 g |
| Coupler C-6 | | 0.09 g |
| Coupler C-10 | | 0.90 g |
| Compound Cpd-E | | 0.09 g |
| Compound Cpd-M | | 0.05 mg |
| High Boiling Point Organic Solvent Oil-2 | | 0.40 g |
| Polymer Latex P-2 | | 0.10 g |
| Sixteenth Layer: First Protective Layer | | |
| Gelatin | | 1.30 g |
| Ultraviolet Absorber U-1 | | 0.10 g |
| Ultraviolet Absorber U-2 | | 0.03 g |
| Ultraviolet Absorber U-5 | | 0.20 g |
| Compound Cpd-F | | 0.40 g |
| Compound Cpd-J | | 0.06 g |
| Dye D-1 | | 0.01 g |
| Dye D-2 | | 0.01 g |
| Dye D-3 | | 0.01 g |
| Dye D-5 | | 0.01 g |
| High Boiling Point Organic Solvent Oil-2 | | 0.37 g |
| Seventeenth Layer: Second Protective Layer | | |
| Fine Grain Silver Iodobromide Emulsion (average grain diameter: 0.06 μm, AgI content: 1 mol %) | silver amount: | 0.05 g |
| Gelatin | | 1.80 g |
| Compound Cpd-L | | 0.8 mg |
| Polymethyl Methacrylate (average particle diameter: 1.5 μm) | | 5.00 g |
| Copolymer of Methyl Methacrylate/Acrylic Acid in Proportion of 6/4 (average particle diameter: 1.5 μm) | | 0.10 g |
| Silicone Oil SO-1 | | 0.030 g |
| Surfactant W-2 | | 0.030 g |

Further, Additives F-1 to F-11 were added to every emulsion layer in addition to the above components. Moreover, gelatin hardener H-1 and surfactants W-1, W-3, W-4, W-5 and W-6 for coating and emulsifying were added to every layer in addition to the above components.

In addition, phenol, 1,2-benzisothiazolin-3-one, 2-phenoxyethanol, phenethyl alcohol, p-hydroxybenzoic acid butyl ester were added as antibacterial and antifungal agents. Light-sensitive emulsions used in Sample No. 101 are shown in Table 1 below.

TABLE 1

| Emulsion | Equivalent-Sphere Diameter (μm) | Variation Coefficient of Equivalent-Circle Diameter (%) | Average Aspect Ratio of Entire Grains | Iodide Content (mol %) | Sensitizing Dye Kind | Sensitizing Dye Addition Amount (× $10^{-4}$ mol/mol-Ag) | Sensitizing Dye Kind | Sensitizing Dye Addition Amount (× $10^{-4}$ mol/mol-Ag) | Sensitizing Dye Kind | Sensitizing Dye Addition Amount (× $10^{-4}$ mol/mol-Ag) |
|---|---|---|---|---|---|---|---|---|---|---|
| A | 0.20 | 16 | 1.6 | 4.0 | S-1 | 8.1 | | | S-3 | 0.3 |
| B | 0.25 | 15 | 3.0 | 4.0 | S-1 | 8.9 | | | S-3 | 0.3 |
| C | 0.22 | 14 | 2.5 | 4.0 | S-1 | 8.8 | S-2 | 0.2 | S-3 | 0.2 |
| D | 0.35 | 10 | 3.6 | 4.0 | S-1 | 9.8 | S-2 | 0.3 | S-3 | 0.2 |
| E | 0.49 | 16 | 5.0 | 2.0 | S-1 | 6.7 | S-2 | 0.5 | S-3 | 0.2 |
| F | 0.15 | 15 | 1.0 | 3.5 | S-4 | 15.1 | S-5 | 1.5 | | |

TABLE 1-continued

| Emulsion | Equivalent-Sphere Diameter (μm) | Variation Coefficient of Equivalent-Circle Diameter (%) | Average Aspect Ratio of Entire Grains | Iodide Content (mol %) | Sensitizing Dye Kind | Sensitizing Dye Addition Amount (× $10^{-4}$ mol/mol-Ag) | Sensitizing Dye Kind | Sensitizing Dye Addition Amount (× $10^{-4}$ mol/mol-Ag) | Sensitizing Dye Kind | Sensitizing Dye Addition Amount (× $10^{-4}$ mol/mol-Ag) |
|---|---|---|---|---|---|---|---|---|---|---|
| G | 0.23 | 14 | 1.9 | 3.5 | S-4 | 10.4 | S-5 | 2.0 | | |
| H | 0.32 | 11 | 2.4 | 3.5 | S-4 | 7.5 | S-5 | 1.4 | | |
| I | 0.28 | 11 | 4.5 | 3.3 | S-4 | 7.7 | S-5 | 1.4 | | |
| J | 0.40 | 16 | 4.0 | 3.3 | S-4 | 7.2 | S-5 | 1.4 | | |
| K | 0.59 | 20 | 5.9 | 2.8 | S-4 | 6.4 | S-5 | 1.2 | | |
| L | 0.24 | 14 | 3.4 | 4.6 | S-6 | 6.5 | S-7 | 2.5 | | |
| M | 0.30 | 10 | 3.0 | 4.6 | S-6 | 6.2 | S-7 | 2.0 | | |
| N | 0.40 | 9 | 4.5 | 1.6 | S-6 | 5.6 | S-7 | 1.8 | | |
| O | 0.60 | 15 | 5.5 | 1.0 | S-6 | 4 | S-7 | 1.5 | | |
| P | 0.80 | 18 | 2.5 | 1.0 | S-6 | 3.4 | S-7 | 1.1 | | |

Note 1) All of the above emulsions were silver bromoiodide emulsions chemically sensitized using gold, sulfur and selenium.

Note 2) All of the above emulsions were added with sensitizing dyes before chemical sensitization.

Note 3) Appropriate amounts of Compounds F-5, F-7, F-8, F-9, F-10, F-11, F-12, F-13, F-14 and V-16 were respectively added to the above emulsions.

Note 4) Emulsions A, B, I and J comprise triple structure tabular grains having major faces comprising {100} faces and other emulsions having major faces comprising {111} faces.

Note 5) Emulsions A, B, E, F, I and P are emulsions whose internal sensitivities are higher than surface sensitivities.

Note 6) Emulsions E, I and P are emulsions comprising chemically sensitized silver bromoiodide substrate grains on which silver chloride was epitaxially grown.

Note 7) Emulsions other than A, E and F comprise grains having 50 or more dislocation lines per one grain observed by a transmission electron microscope.

Preparation of Dispersion of Organic Solid Dispersion Dye

Dye E-1 shown below was dispersed according to the following method. That is, water and 70 g of W-4 were added to 1,400 g of a wet cake of the dye containing 30% of water, and stirred to obtain a slurry having 30% dye concentration. Next, 1,700 ml of zirconia beads having an average diameter of 0.5 mm were filled in an ultravisco mill (UVM-2) manufactured by Aimex Co., the slurry was passed and the content was pulverized at a peripheral speed of about 10 m/sec and discharge amount of 0.5 l/min for 8 hours. Beads were removed by filtration and the resulting dispersion was heated at 90° C. for 10 hours for stabilization, then water and gelatin were added to dilute the dispersion to dye concentration of 3%. The average grain diameter of the obtained fine grains of the dye was 0.4 μm and the extent of distribution of grain diameters ((standard deviation of grain diameters)/(average grain diameter)×100) was 18%.

Preparation of Sample Nos. 100, 102 to 111:

Sample Nos. 102 to 111 were prepared by replacing Sensitizing Dyes S-4 and S-5 in Emulsions F to K used in Sample No. 101 with equimolar amounts of the dyes as shown in Table 2 below, and Sample No. 100 was prepared by excluding dyes. Each piece of the samples thus obtained was subjected to 20 CMS white light exposure for 1/100 sec. through a gray wedge, then processed by the following processing step, and sensitometry was carried out. The magenta stain density of dye-free Sample No. 100 was subtracted from the magenta stain density of each piece of the samples after processing and residual color was evaluated. Measurement of the magenta stain density was performed using a densitometer Status A, a product of X-RITE Co.

C-1

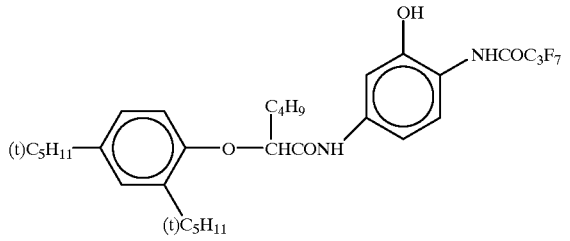

-continued
C-2
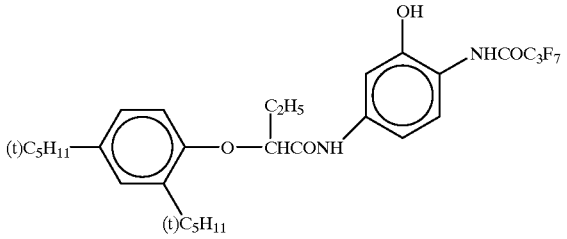
C-3
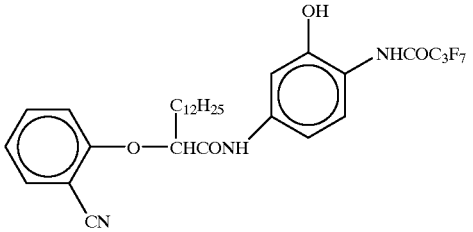
C-4
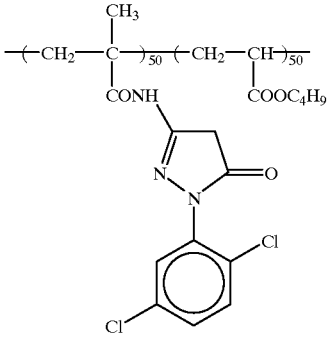
numerals indicate % by weight
average molecular weight: about 25,000
C-5
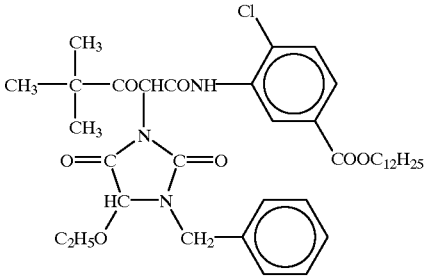
C-6
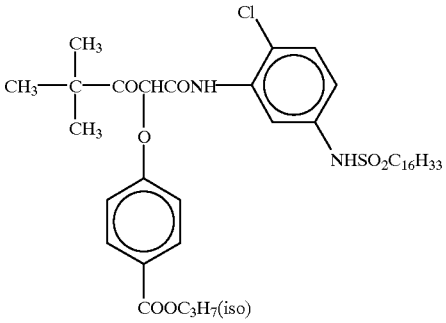

-continued
C-7
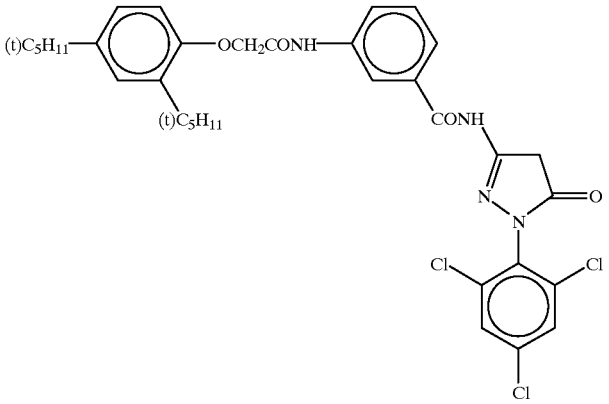
C-8
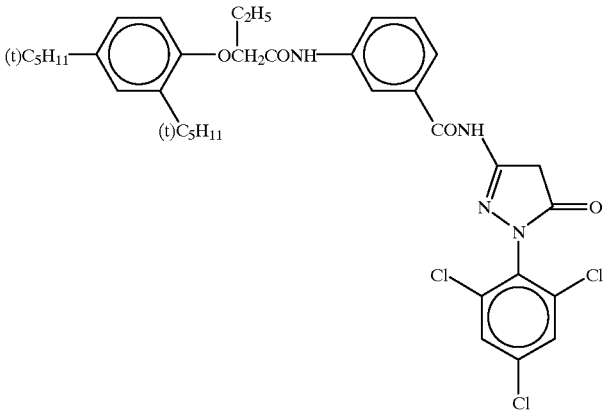
C-9
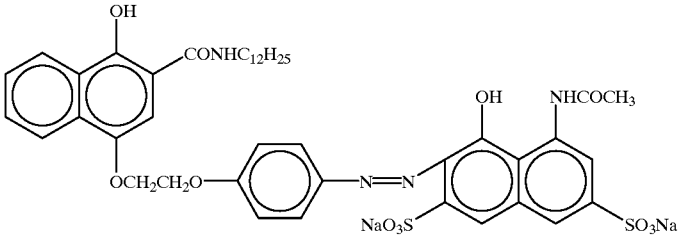
C-10
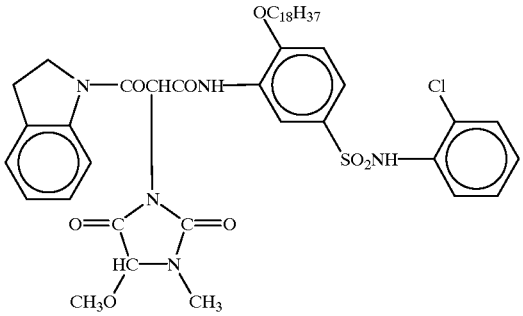
Oil-1
Dibutyl Phthalate
Oil-2
Tricresyl Phosphate
Oil-3
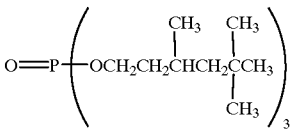

-continued
Cpd-A
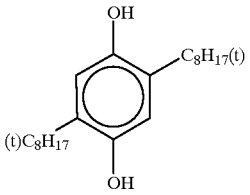
Cpd-B
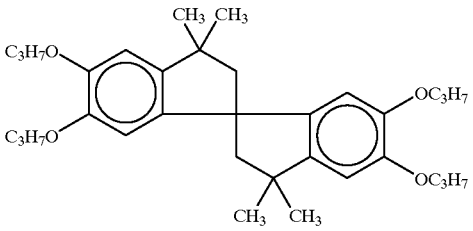
Cpd-C
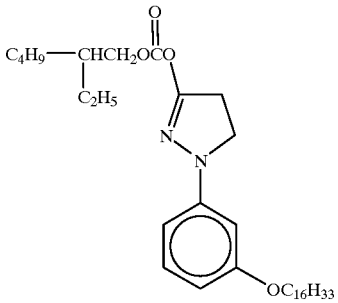
Cpd-D
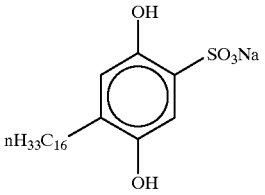
Cpd-E
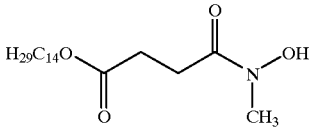
Cpd-F
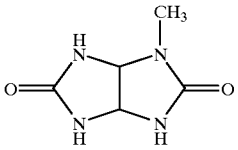
Cpd-G
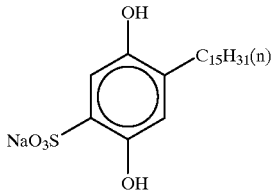
Cpd-H
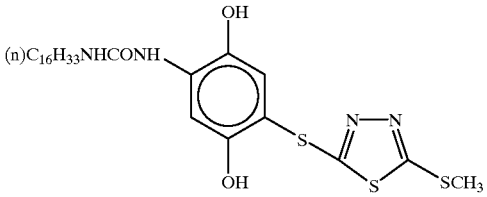
Cpd-I
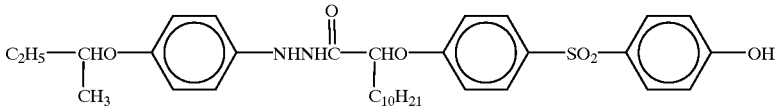
Cpd-K
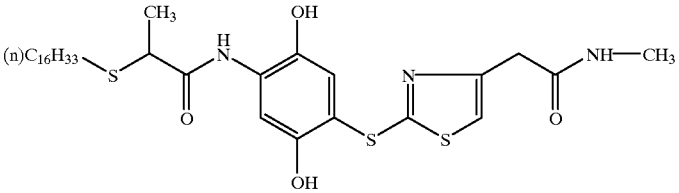

-continued
Cpd-J
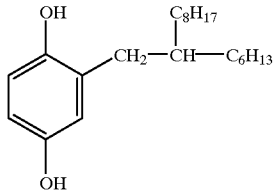
Cpd-L
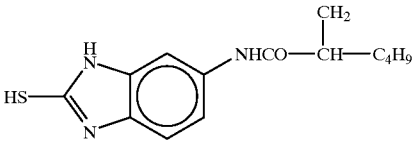
Cpd-M
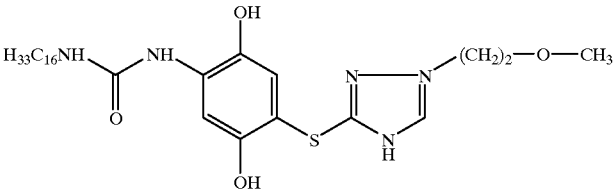
U-1
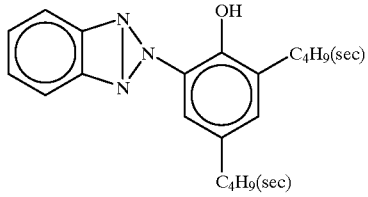
U-2
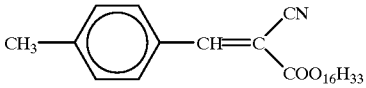
U-3
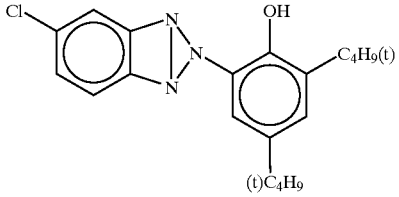
U-4
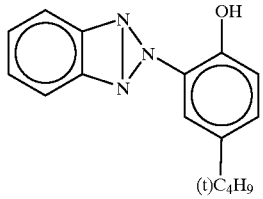
U-5
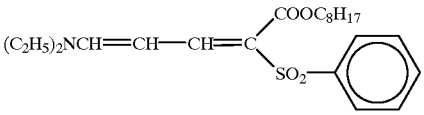
S-1
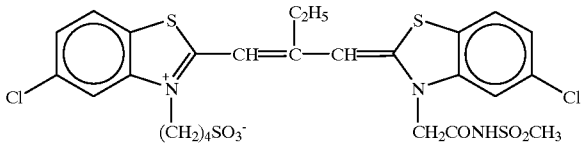

-continued
S-2
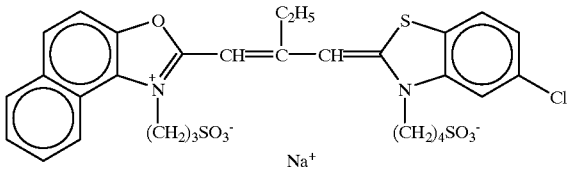
S-3
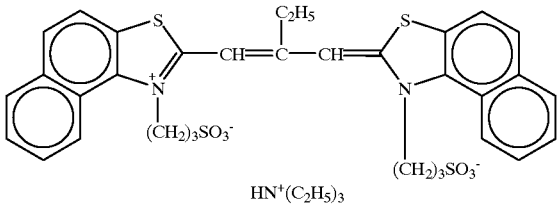
S-4
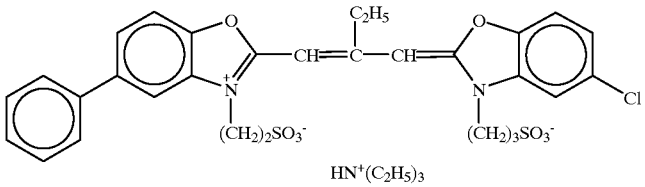
S-5
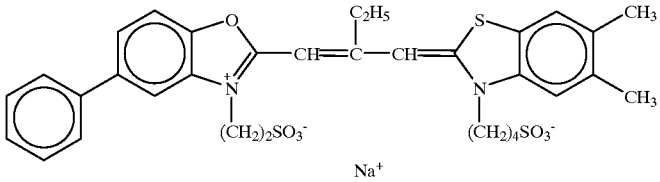
S-6
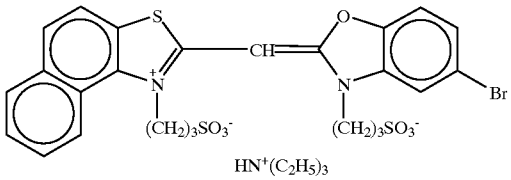
S-7
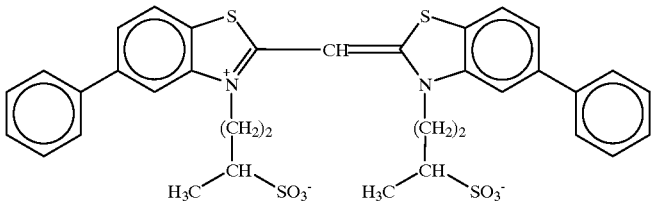
S-8
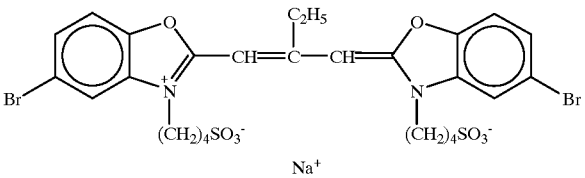

-continued
S-9
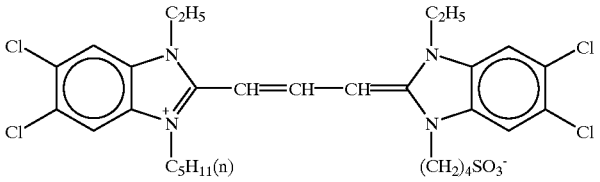
D-1
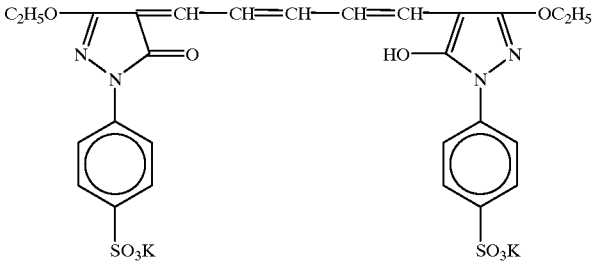
D-2
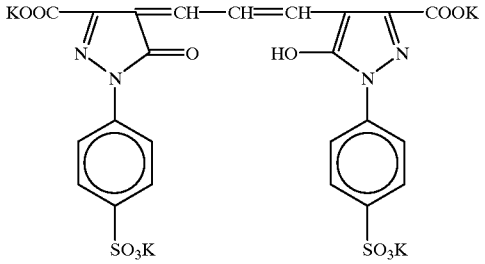
D-3
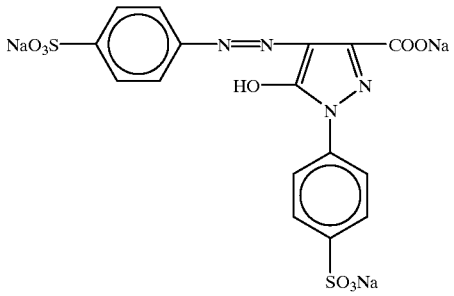
D-4
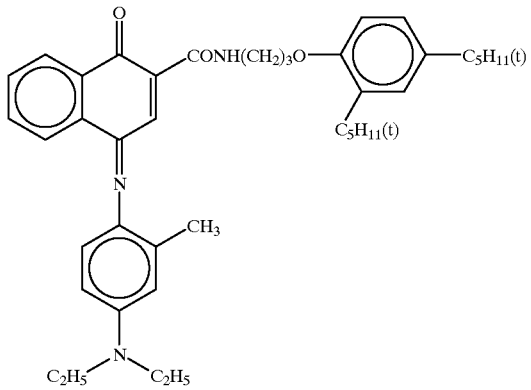

-continued
D-5
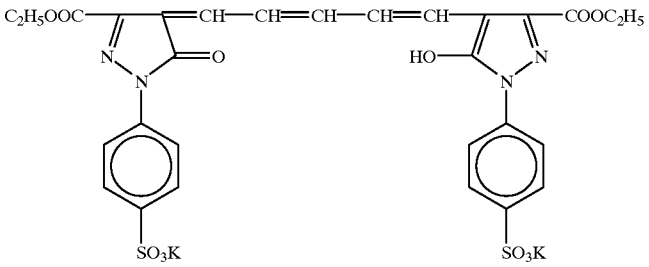
E-1
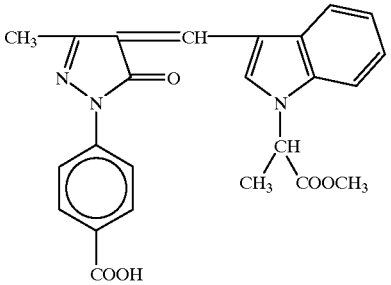
H-1
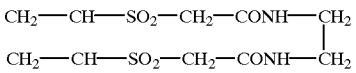
W-1
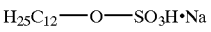
W-2
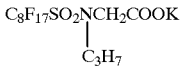
W-3
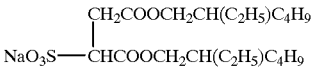
W-4
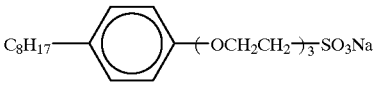
W-5
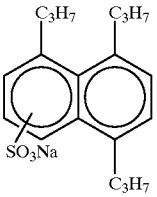
W-6
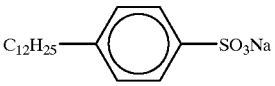
P-1
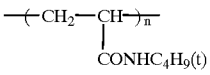
(n = 100 - 1,000)
M-1
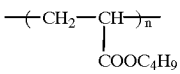
(n = 100 - 1,000)
SO-1
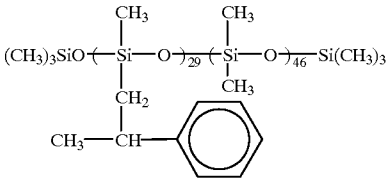
the numerals each indicates polymerization degree.
P-2
Polybutyl acrylate/acrylic acid copolymer in proportion of 95/5

-continued

F-1

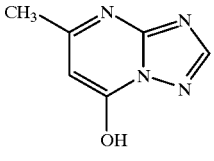

F-2

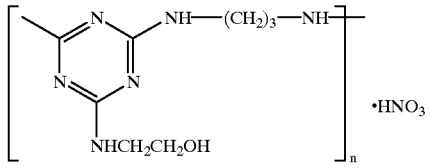

(n = 3 ~ 4)

F-3

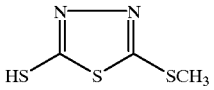

F-4

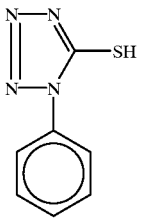

F-5

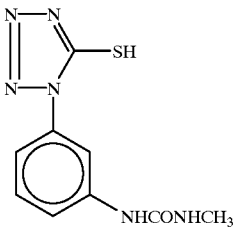

F-6

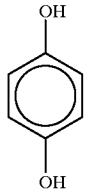

F-7

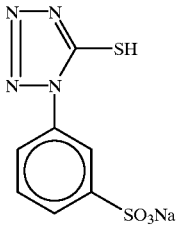

F-8

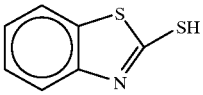

F-9

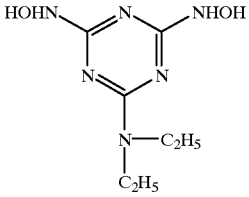

F-10

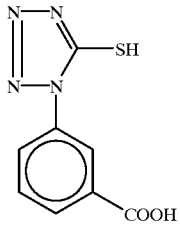

F-11

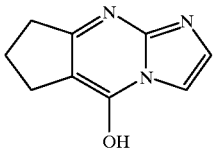

F-12

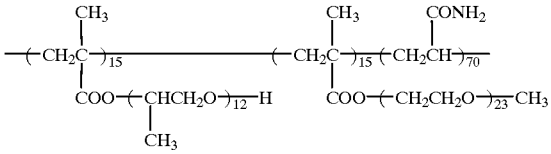

numerals indicate % by mole.
average molecular weight: about 30,000

F-13

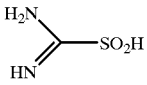

F-14

$K_2IrCl_6$

-continued

Processing

| Processing Step | Processing Time (min) | Processing Temperature (° C.) | Tank Capacity (liter) | Replenishing Rate (ml/m$^2$) |
|---|---|---|---|---|
| First Development | 6 | 38 | 12 | 2,200 |
| First Washing | 2 | 38 | 4 | 7,500 |
| Reversal | 2 | 38 | 4 | 1,100 |
| Color Development | 6 | 38 | 12 | 2,200 |
| Pre-bleaching | 2 | 38 | 4 | 1,100 |
| Bleaching | 6 | 38 | 2 | 220 |

-continued

Processing

| Processing Step | Processing Time (min) | Processing Temperature (° C.) | Tank Capacity (liter) | Replenishing Rate (ml/m$^2$) |
|---|---|---|---|---|
| Fixing | 4 | 38 | 8 | 1,100 |
| Second Washing | 4 | 38 | 8 | 7,500 |
| Final Rinsing | 1 | 25 | 2 | 1,100 |

The composition of each processing solution used was as follows.

| | Tank Solution | Replenisher |
|---|---|---|
| First Developing Solution | | |
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinonemonosulfonate | 20 g | 20 g |
| Potassium Carbonate | 15 g | 20 g |
| Sodium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1,000 ml | 1,000 ml |
| pH (adjusted with sulfuric acid or potassium hydroxide | 9.60 | 9.60 |
| Reversal Solution | | |
| Pentasodium Nitrilo-N,N,N-trimethylenephosphonate | 3.0 g | same as the tank solution |
| Stannous Chloride Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| Color Developing Solution | | |
| Pentasodium Nitrilo-N,N,N-trimethylenephosphonate | 2.0 g | 2.0 g |
| Sodium Sulfite | 7.0 g | 7.0 g |
| Trisodium Phosphate Dodecahydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline.3/2 Sulfate. Monohydrate | 11 g | 11 g |
| 3,6-Dithiaoctane-1,8-diol | 1.0 g | 1.0 g |
| Water to make | 1,000 ml | 1,000 ml |
| pH (adjusted with sulfuric acid or potassium hydroxide) | 11.80 | 12.00 |
| Pre-bleaching Solution | | |
| Disodium Ethylenediaminetetraacetate Dihydrate | 8.0 g | 8.0 g |
| Sodium Sulfite | 6.0 g | 8.0 g |
| 1-Thioglycerol | 0.4 g | 0.4 g |
| Sodium Bisulfite Addition Products of Formaldehyde | 30 g | 35 g |
| Water to make | 1,000 ml | 1,000 ml |
| pH (adjusted with acetic or sodium hydroxide) | 6.30 | 6.10 |
| Bleaching Solution | | |
| Disodium Ethylenediaminetetraacetate Dihydrate | 2.0 g | 4.0 g |
| Ammonium Ethylenediamine tetraacetato Ferrate Dihydrate | 120 g | 240 g |
| Potassium Bromide | 100 g | 200 g |
| Ammonium Nitrate | 10 g | 20 g |
| Water to make | 1,000 ml | 1,000 ml |

-continued

| | Tank Solution | Replenisher |
|---|---|---|
| pH (adjusted with nitric acid or sodium hydroxide) | 5.70 | 5.50 |
| Fixing Solution | | |
| Ammonium Thiosulfate | 80 g | same as the tank solution |
| Sodium Sulfite | 5.0 g | same as the tank solution |
| Sodium Bisulfite | 5.0 g | same as the tank solution |
| Water to make | 1,000 ml | same as the tank solution |
| pH (adjusted with acetic acid or aqueous ammonia) | 6.60 | |
| Final Rinsing Solution | | |
| 1,2-Benzisothiazolin-3-one | 0.02 g | 0.03 g |
| Polyoxyethylene-p-monononylphenyl Ether (average polymerization degree: 10) | 0.3 g | 0.3 g |
| Polymaleic Acid (average molecular weight: 2,000) | 0.1 g | 0.15 g |
| Water to make | 1,000 ml | 1,000 ml |
| pH | 7.0 | 7.0 |

The results of sensitometry and evaluation of residual color are shown in Table 2 below. GL relative sensitivity was compared based on the relative exposure amount giving the density larger than the minimum density by 1.0.

TABLE 2

| Sample No. | GL Dye | | GL Relative Sensitivity | Magenta Residual Color Density |
|---|---|---|---|---|
| 100 (blank) | none | none | — | 0 (control) |
| 101 (comparison) | S-4 | S-5 | 100 | 0.068 |
| 102 (comparison) | S-4 | IV-1 | 105 | 0.053 |
| 103 (comparison) | S-8 | S-5 | 102 | 0.061 |
| 104 (comparison) | S-8 | IV-1 | 107 | 0.047 |
| 105 (comparison) | III-1 | S-5 | 104 | 0.025 |
| 106 (comparison) | III-1 | S-9 | 94 | 0.010 |
| 107 (invention) | III-1 | IV-1 | 109 | 0.005 |
| 108 (invention) | III-1 | IV-2 | 108 | 0.011 |
| 109 (invention) | III-1 | IV-3 | 107 | 0.013 |
| 110 (invention) | III-2 | IV-1 | 107 | 0.004 |
| 111 (invention) | III-4 | IV-1 | 110 | 0.007 |

As is apparent from the results in Table 2, a photographic material exhibiting less residual color and high sensitivity can be obtained by the compound and the emulsion according to the present invention. It is apparent that high sensitivity and less residual color can be compatible due to the constitution of the present invention for the first time.

High sensitivity and good residual color preventing effect can be obtained by the constitution according to the present invention.

While the invention has been described in detail and with reference to specific examples thereof, it will be apparent to one skilled in the art that various changes and modifications can be made therein without departing from the spirit and scope thereof.

What is claimed is:

1. A silver halide photographic material which contains at least one compound represented by the following formula (I) and at least one compound represented by the following formula (II):

(I)

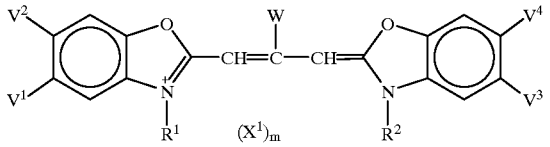

wherein $R^1$ and $R^2$ each represents an alkyl group; W represents a hydrogen atom, a methyl group or an ethyl group; $V^1$, $V^2$, $V^3$ and $V^4$ each represents a hydrogen atom, a fluorine atom, a chlorine atom, an alkoxyl group, a hydroxyl group or a carboxyl group; $X^1$ represents a counter ion; and m represents a number of 0 or more necessary for neutralizing a charge in the molecule;

(II)

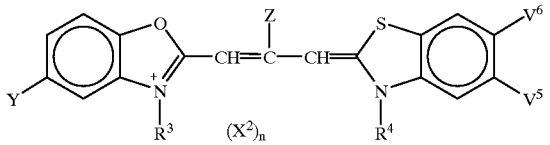

wherein $R^3$ and $R^4$ each represents an alkyl group, and at least one of $R^3$ and $R^4$ represents a carboxyalkyl group or an alkanesulfonylcarbamoylalkyl group; Z represents a hydrogen atom, a methyl group or an ethyl group; Y represents an aryl group or a heterocyclic group; $V^5$ and $V^6$ each represents a hydrogen atom, a halogen atom, an alkoxyl group, a hydroxyl group or a carboxyl group; $X^2$ represents a counter ion; and n represents a number of 0 or more necessary for neutralizing a charge in the molecule.

2. The silver halide photographic material as claimed in claim 1, wherein said silver halide photographic material contains at least one compound represented by the following formula (III) and at least one compound represented by the following formula (IV):

(III)

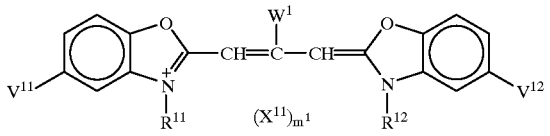

wherein $R^{11}$ and $R^{12}$ each represents a sulfoalkyl group; $W^1$ represents a methyl group or an ethyl group; $V^{11}$ and $V^{12}$ each represents a fluorine atom, a chlorine atom, an alkoxyl group or a hydroxyl group; $X^{11}$ represents a counter ion; and $m^1$ represents a number of 0 or more necessary for neutralizing a charge in the molecule;

(IV)

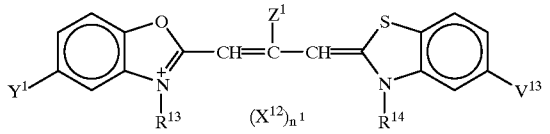

wherein $R^{13}$ represents a sulfoalkyl group; $R^{14}$ represents a carboxyalkyl group or an alkanesulfonylcarbamoylalkyl group; $Z^1$ represents a methyl group or an ethyl group; $Y^1$ represents an aryl group; $V^{13}$ represents a hydrogen atom, a fluorine atom, a chlorine atom, an alkoxyl group or a hydroxyl group; $X^{12}$ represents a counter ion; and $n^1$ represents a number of 0 or more necessary for neutralizing a charge in the molecule.

3. A silver halide photographic material comprising a support having provided thereon at least one silver halide emulsion layer, wherein silver halide grains of said emulsion layer are reduction sensitized and said silver halide photographic material contains at least one compound represented by the following formula (I) and at least one compound represented by the following formula (II):

(I)

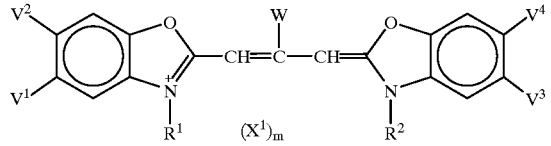

wherein $R^1$ and $R^2$ each represents an alkyl group; W represents a hydrogen atom, a methyl group or an ethyl group; $V^1$, $V^2$, $V^3$ and $V^4$ each represents a hydrogen atom, a fluorine atom, a chlorine atom, an alkoxyl group, a hydroxyl group or a carboxyl group; $X^1$ represents a counter ion; and m represents a number of 0 or more necessary for neutralizing a charge in the molecule;

(II)

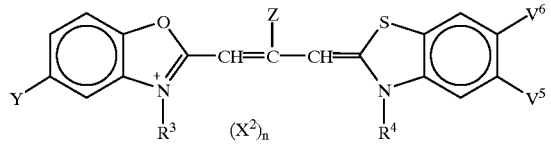

wherein $R^3$ and $R^4$ each represents an alkyl group, and at least one of $R^3$ and $R^4$ represents a carboxyalkyl group or an alkanesulfonylcarbamoylalkyl group; Z represents a hydrogen atom, a methyl group or an ethyl group; Y represents an aryl group or a heterocyclic group; $V^5$ and $V^6$ each represents a hydrogen atom, a halogen atom, an alkoxyl group, a hydroxyl group or a carboxyl group; $X^2$ represents a counter ion; and n represents a number of 0 or more necessary for neutralizing a charge in the molecule.

4. The silver halide photographic material as claimed in claim 3 which comprises a support having provided thereon at least one silver halide emulsion layer, wherein silver halide grains of said emulsion layer are reduction sensitized and said silver halide photographic material contains at least one compound represented by the following formula (III) and at least one compound represented by the following formula (IV):

(III)

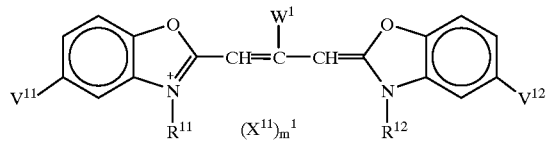

wherein $R^{11}$ and $R^{12}$ each represents a sulfoalkyl group; $W^1$ represents a methyl group or an ethyl group; $V^{11}$ and $V^{12}$ each represents a fluorine atom, a chlorine atom, an alkoxyl group or a hydroxyl group; $X^{11}$ represents a counter ion; and $m^1$ represents a number of 0 or more necessary for neutralizing a charge in the molecule;

(IV)

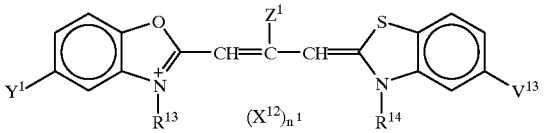

wherein $R^{13}$ represents a sulfoalkyl group; $R^{14}$ represents a carboxyalkyl group or an alkanesulfonylcarbamoylalkyl group; $Z^1$ represents a methyl group or an ethyl group; $Y^1$ represents an aryl group; $V^{13}$ represents a hydrogen atom, a fluorine atom, a chlorine atom, an alkoxyl group or a hydroxyl group; $X^{12}$ represents a counter ion; and $n^1$ represents a number of 0 or more necessary for neutralizing a charge in the molecule.

5. The silver halide photographic material as claimed in claim 3, wherein said silver halide grains are reduction sensitized with at least one compound represented by the following formula (V), (VI) or (VII):

$$R^{101}—SO_2S—M^{101} \quad (V)$$

$$R^{101}—SO_2S—R^{102} \quad (VI)$$

$$R^{101}—SO_2S—(E)_a—SSO_2—R^{103} \quad (VII)$$

wherein $R^{101}$, $R^{102}$ and $R^{103}$ each represents an aliphatic group, an aromatic group or a heterocyclic group; $M^{101}$ represents a cation; E represents a divalent linking group, and a represents 0 or 1.

6. The silver halide photographic material as claimed in claim 4, wherein said silver halide grains are reduction sensitized with at least one compound represented by the following formula (V), (VI) or (VII):

$$R^{101}—SO_2S—M^{101} \quad (V)$$

$$R^{101}—SO_2S—R^{102} \quad (VI)$$

$$R^{101}—SO_2S—(E)_a—SSO_2—R^{103} \quad (VII)$$

wherein $R^{101}$, $R^{102}$ and $R^{103}$ each represents an aliphatic group, an aromatic group or a heterocyclic group; $M^{101}$ represents a cation; E represents a divalent linking group, and a represents 0 or 1.

* * * * *